US010675774B1

(12) United States Patent
Epstein

(10) Patent No.: US 10,675,774 B1
(45) Date of Patent: Jun. 9, 2020

(54) CROSS-CUT STABILIZER USED IN HORIZONTAL, FORM, FILL, AND SEAL PACKAGING MACHINES

(71) Applicant: Moshe Epstein, Northbrook, IL (US)

(72) Inventor: Moshe Epstein, Northbrook, IL (US)

( * ) Notice: Subject to any disclaimer, the term of this patent is extended or adjusted under 35 U.S.C. 154(b) by 0 days.

(21) Appl. No.: 16/656,516

(22) Filed: Oct. 17, 2019

(51) Int. Cl.

| | |
|---|---|
| ***B26D 7/01*** | (2006.01) |
| ***B26D 7/00*** | (2006.01) |
| ***B26D 7/26*** | (2006.01) |
| ***B26D 1/08*** | (2006.01) |

(52) U.S. Cl.
CPC ..... *B26D 7/0006* (2013.01); *B26D 1/085* (2013.01); *B26D 7/2614* (2013.01); *B26D 7/2628* (2013.01)

(58) Field of Classification Search
CPC .. B26D 7/0006; B26D 7/2614; B26D 7/2628; B26D 1/085; B26D 5/083; B65B 61/10; B65B 61/06; B65B 61/007; B65B 61/04; B65B 61/28; B65B 69/0033; B65B 2220/06; B65B 9/04; B65B 9/042; B65B 11/50; B65B 47/08; B31B 50/18; B31B 50/20; B31B 50/14; B31B 50/16; B31B 70/16; B31B 70/18; B31B 70/20
USPC ..... 53/453, 559; 83/83
See application file for complete search history.

(56) References Cited

U.S. PATENT DOCUMENTS

| | | | | |
|---|---|---|---|---|
| 7,051,633 | B2 * | 5/2006 | Weiler | B26D 1/03 83/425.3 |
| 8,291,799 | B2 * | 10/2012 | Graushar | B26D 1/085 83/247 |
| 10,479,579 | B2 * | 11/2019 | Pendergraph | B65D 15/00 |
| 2008/0250908 | A1 * | 10/2008 | Totani | B26D 5/08 83/76 |
| 2018/0281219 | A1 * | 10/2018 | Larsson-Hall | B26D 5/12 |

FOREIGN PATENT DOCUMENTS

| | | | | |
|---|---|---|---|---|
| DE | 2218395 | A1 * | 10/1973 | B65B 61/06 |
| DE | 19609527 | A1 * | 9/1997 | B41J 11/703 |

* cited by examiner

*Primary Examiner* — Thanh K Truong
*Assistant Examiner* — Thomas M Wittenschlaeger
(74) *Attorney, Agent, or Firm* — Steven Ivy P.C.

(57) ABSTRACT

Disclosed is a cross-cut stabilizer. The stabilizer prevents uncontrollable movement of the existing cross-cut stations, which are used in packaging machines to make long cuts designed to separate a strip of multiple, pre-packaged products from the rest of the packaging film. The movement created by the machine's vibration, causes the cutting blocks, along with the blades making the cross-cuts, to move unpredictably. The movement is compounded by the rack and pinion system which supports the cutting blocks of the cross-cut station. The cross-cut stabilizer, incorporates a mounting base, which holds pushing combs and manual clamps. The stabilizer is mounted inside the cross-cut station, allowing the pushing combs to straddle the existing cutting blocks. The pushing combs enable unison, manual adjustment of the cross-cut station with the cross-cut stabilizer. By using clamps, the pushing combs urge down on the cutting blocks of the cross-cut station, eliminating any movement of the station.

13 Claims, 14 Drawing Sheets

100 - 144
CROSS CUT
STABILIZER ASSEMBLY

STRIP OF MULTIPLE, PRE-PACKAGED PRODUCTS

PRIOR ART 200-208
CROSS CUT STATION

SECTION A-A

CROSS-CUT STABILIZER USED IN HORIZONTAL, FORM, FILL, AND SEAL PACKAGING MACHINES

FIELD OF THE INVENTION

The present invention relates to the general field of tooling, used in automated, horizontal, packaging machines.

BACKGROUND OF THE INVENTION

The present invention is a direct attempt to improve the operational functionality of previously designed horizontal, form, fill and seal packaging machines. More specifically, to improve the design, and functionality of a cross-cut station used on the packaging machines.

The cross-cut station is typically one of the last operational stations on a packaging machine. It is frequently preceded by various other functional stations, including but not limited to packaging film feeding station, package forming station, product fill station, and package perforating station.

The primary purpose of the cross-cut station is to generate long cross-cuts, designed to separate a long strip of the pre-packaged film (film containing several packages of product separated by perforations) away from the rest of the packaging film, being fed by the conveying chain.

These cross-cuts must be performed in predetermined locations, and they require a relatively high level of precision and redundancy. However, due to the vibrations generated by machine's operations, the blades responsible for making the cuts in the packaging film, are progressively moved away from the desired locations of the cross-cuts.

This progressive movement of the cross-cut station can be, at least in part, attributed to the rack and pinion system incorporated in the design of the existing cross-cut station. The rack and pinion is embedded inside the cutting blocks, designed to prevent the movement of the film being cut by the blades extending from below.

The other reason for the movement of the cross-cut station can be attributed to an unreliable locking nut, also incorporated into the cross-cut design. As the name implies, the locking nut has been designed to lock the cross-cut station in place, and by doing so prevent its movement. However, after a prolonged exposure to the vibrating frame of the machine, the lock nut frequently loses its grip, allowing the cross-cut station to move in an unpredicted direction.

The present invention eliminates this problem by incorporating a retrofittable device, called the cross-cut stabilizer. The cross-cut stabilizer incorporates a mounting base, which holds pushing combs and manual clamps. The clamps, having manually-adjustable knobs, clamp onto the mounting block and the machine's rack and pinion system, or any other immovable component of the machine. This clamping action acts as a break. The stabilizer is mounted in-between the cross-cut station's cutting blocks, allowing the pushing combs to straddle these cutting blocks.

Once installed, the pushing combs enable simultaneous, manual adjustment of both the cross-cut station (holding the blades) with the cross-cut stabilizer. By manually adjusting the clamps, the pushing combs urge down on the cutting blocks of the cross-cut station, thereby eliminating any movement of the cross-cut station and the attached thereto blades.

BRIEF SUMMARY OF THE INVENTION

The following information is intended to be a brief summary of the invention, and as such, said information shall not be used as the means of limiting the scope of the invention:

Disclosed is a cross-cut stabilizer, used in horizontal, form, fill and seal packaging machines. Specifically, the cross-cut stabilizer is configured to prevent any uncontrollable movement of the existing cross-cut station, which is used in packaging machines to make long cuts designed to separate a strip of multiple, pre-packaged products, from the rest of the packaging film. This separation of the prepackages takes place at end of the machine's operation. The movement of the existing cross-cut station is created by the machine's vibration, which causes the cutting blocks, along with the blades making the cross-cuts, to move in unpredictable directions. This movement is compounded by the unreliable rack and pinion system which supports the cutting blocks of the cross-cut station. The cross-cut stabilizer, incorporates a mounting base, which holds pushing combs and manual clamps. The clamps, having manually-adjustable knobs, clamp onto the mounting block and the machine's rack and pinion system, or any other immovable component of the machine. This clamping action acts as a break. The stabilizer is mounted in-between the cross-cut station's cutting blocks, allowing the pushing combs to straddle these cutting blocks. Once installed, the pushing combs enable simultaneous, manual adjustment of both the cross-cut station (holding the blades) with the cross-cut stabilizer. By manually adjusting the clamps, the pushing combs are lowered and eventually urge down on the cutting blocks of the cross-cut station, thereby eliminating any movement of the cross-cut station and the attached thereto blades.

BRIEF DESCRIPTION OF THE DRAWINGS

The components shown in the drawings are not to scale. In the interest of clarity, some of the components might be shown in a generalized form and could be identified utilizing commercial designations. All components, including its essential features, have been assigned reference numbers that are utilized consistently throughout the descriptive process outlined herein.

DESCRIPTIVE KEY

Present Invention

100-144 Cross-Cut Stabilizer Assembly
- 100-107 Mounting Base
  - 100—top surface, mounting base
  - 101—bottom surface, mounting base
  - 102—long sides, mounting base
  - 103—short sides, mounting base
  - 104—sliding steps, mounting base
  - 105—threaded holes, mounting base
  - 106—clearance holes, mounting base
  - 107—knob hole, mounting base
- 110-114 Pushing Comb
  - 110—top surface, pushing comb
  - 111—mounting chamber, pushing comb
  - 112—first chamber, pushing comb
  - 113—second chamber, pushing comb
  - 114—clearance holes, pushing comb
- 120—122 Jaw Guide
  - 120—top surface, jaw guide
  - 121—chamber, jaw guide
  - 122—threaded holes, jaw guide
- 130—133 Clamp
  - 130—knob, clamp
  - 131—screw, clamp

132—jaw block, clamp
133—threaded hole, clamp
140-143 Fasteners
140—machine screws
141—washers
142—nuts
143—bolts
144—adhesive
Prior Art
200-222 Horizontal Form, Fill and Seal Packaging Machine
200-208 cross-cut station
200—first cutting block
201—second cutting block
202—adjustment knobs
203—locking nuts
204—blades
205—blade holders
206—pneumatic cylinders
207—sliding rail
208—rack and pinion
209—conveying chain
210—packaging film
211—power and control station
212—computer and operating software
213—air compressor
214—electric motors
215—vacuum pump
216—bottom packaging film feeding roll
217—bottom package forming station
218—product fill station
219—packaged product
220—top packaging film feeding roll
221—top package sealing station
222—package perforation station

DETAILED DESCRIPTION OF THE PREFERRED EMBODIMENT

The following description references to the above-defined drawings and represents only an exemplary embodiment of the invention. It is foreseeable, and recognizable by those skilled in the art, that various modifications and/or substitutions to the invention could be implemented without departing from the scope and the character of the invention:

Disclosed is a cross-cut stabilizer assembly 100-144, shown in FIGS. 01-04. The assembly is retrofitted onto the existing cross-cut station 200-208, used in horizontal, form, fill and seal packaging machines 200-222 (both identified herein as Prior Art).

Specifically, the cross-cut stabilizer 100-144 is configured to prevent any uncontrollable movement of the existing cross-cut station 200-208, caused by the machine's 200-222 vibration occurring during its operation. The cross-cut station 200-208 is used in the packaging machines to make long cuts designed to separate strips of multiple, pre-packaged products 219, from the rest of the packaging film 210, progressing through the machine 200-222 via the conveying chain 209.

Figure 1:
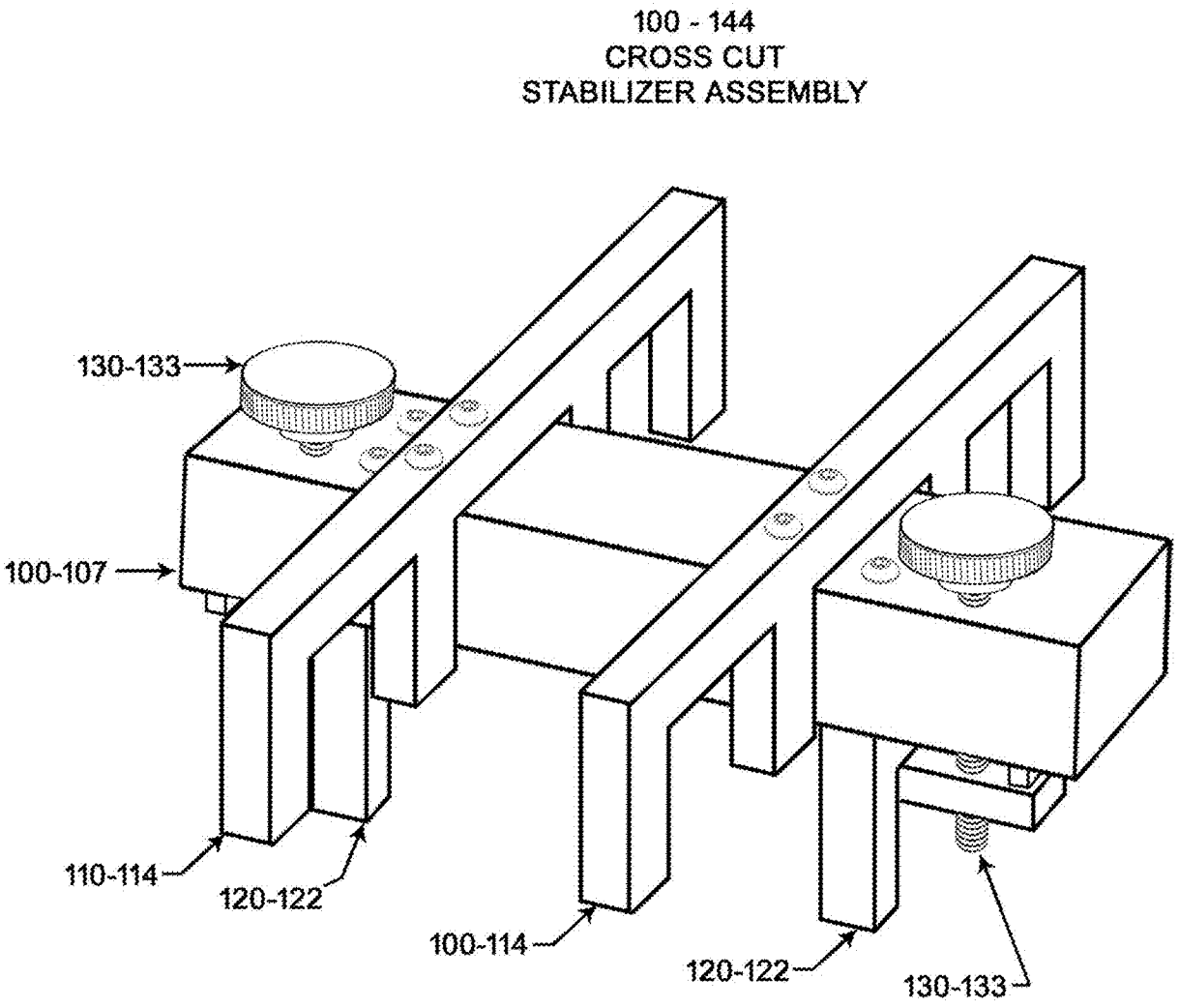
FIG. 1 is a perspective view of the cross-cut stabilizer assembly; the view shows the fully-assembled cross-cut stabilizer and component numbers with leaders pointing to the four primary components of the assembly, including (1) mounting base, (2) pushing comb, (3) jaw guide, and (4) clamp; in accordance with an exemplary embodiment of the present invention.
Figure 2:
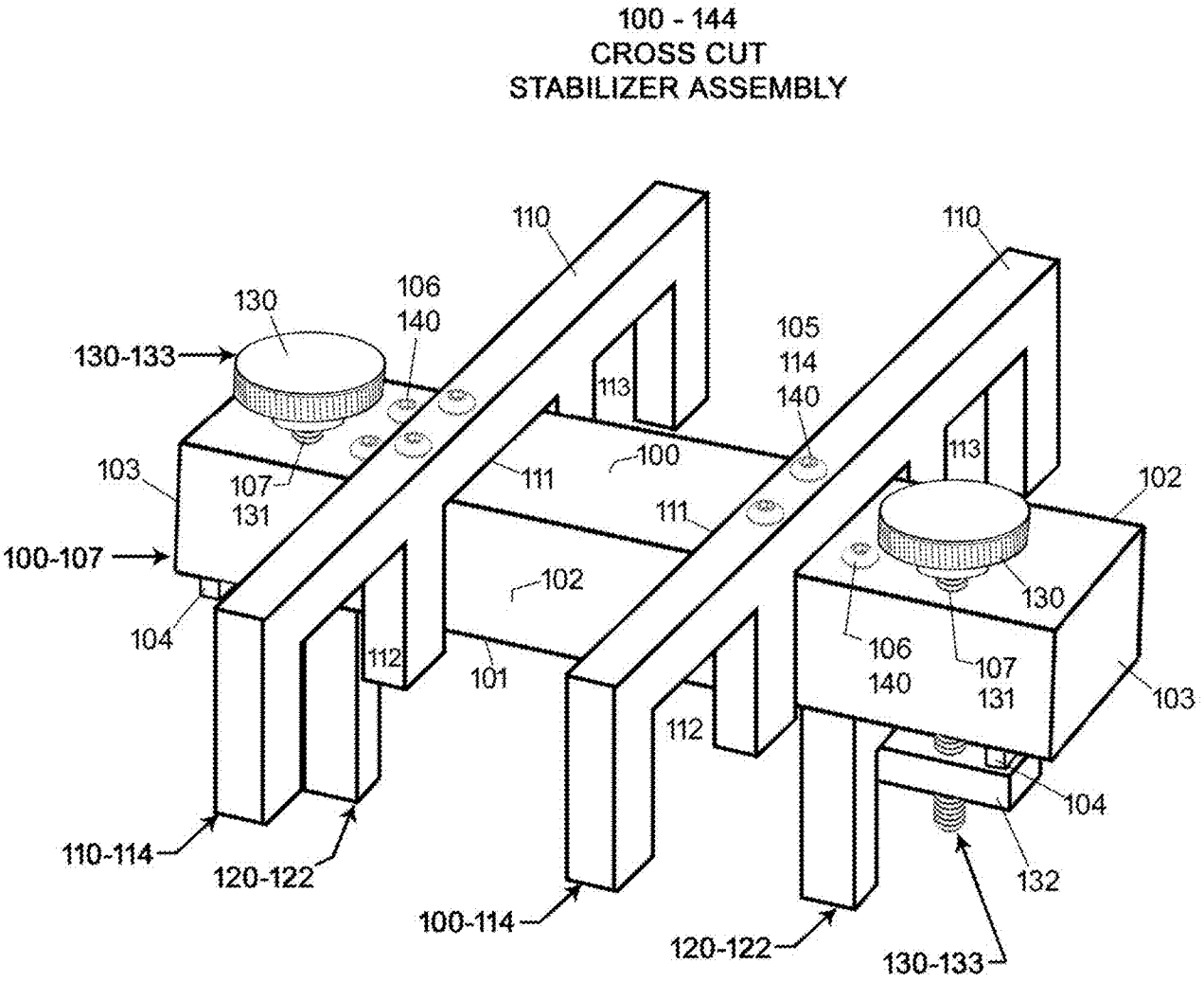
FIG. 2 is a perspective view of the cross-cut stabilizer assembly; the view shows the fully-assembled cross-cut stabilizer with leaders pointing to all components of the assembly; in accordance with an exemplary embodiment of the present invention.

As shown in FIGS. 01 and 02, the cross-cut stabilizer assembly 100-144 comprises of four primary components/subassemblies: (1) mounting base 100-107; (2) pushing comb 110-114; (3) jaw guide 120-122; (4) clamp 130-133.

Figure 3:
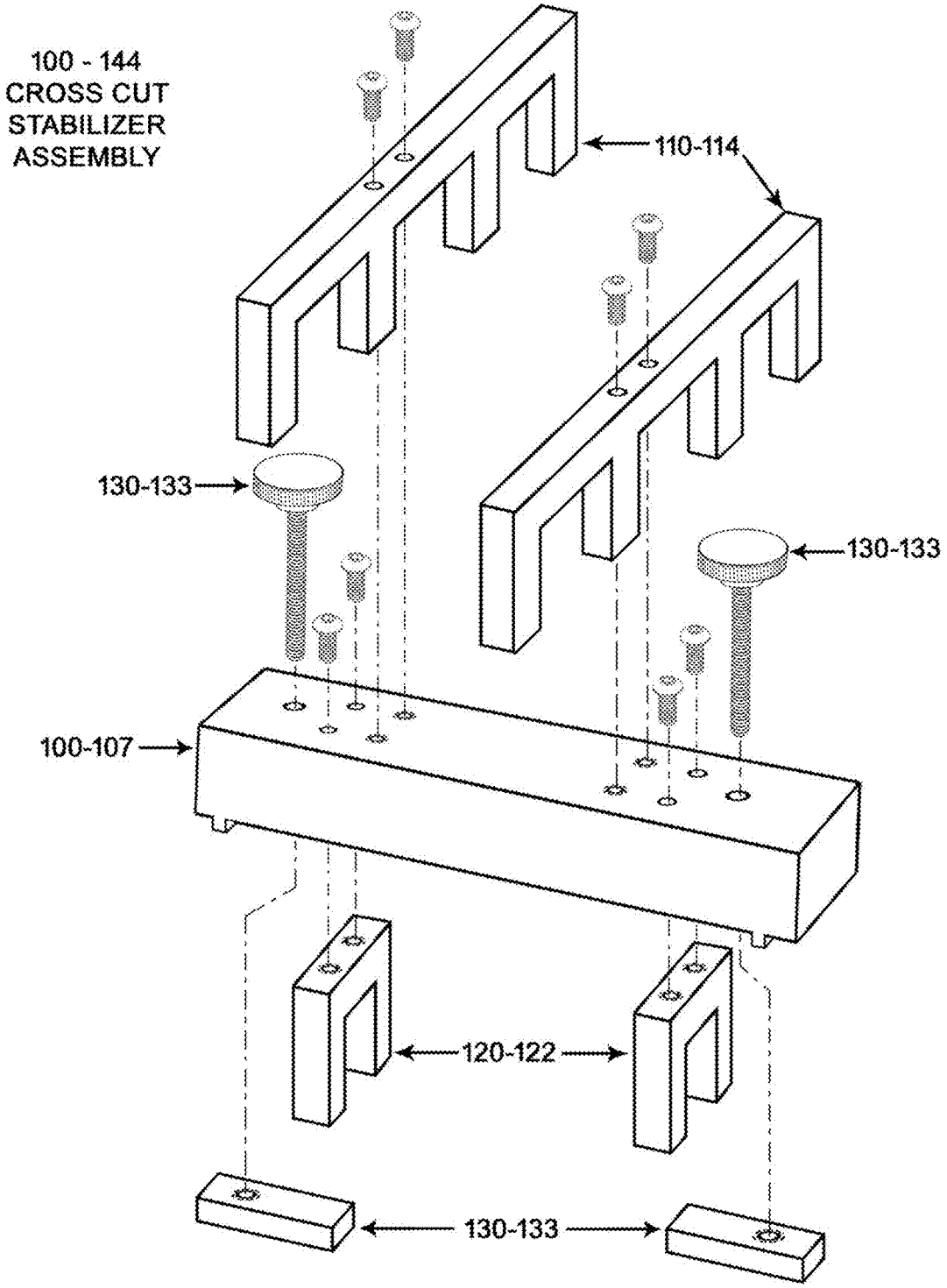
FIG. 3 is an exploded view of the cross-cut stabilizer assembly; the view shows a perspective view of each individual component incorporated into the assembly, along with component numbers and the leaders pointing to the four primary components of the assembly: (1) mounting base; (2) pushing comb; (3) jaw guide; (4) clamp; in accordance with an exemplary embodiment of the present invention.
Figure 4:
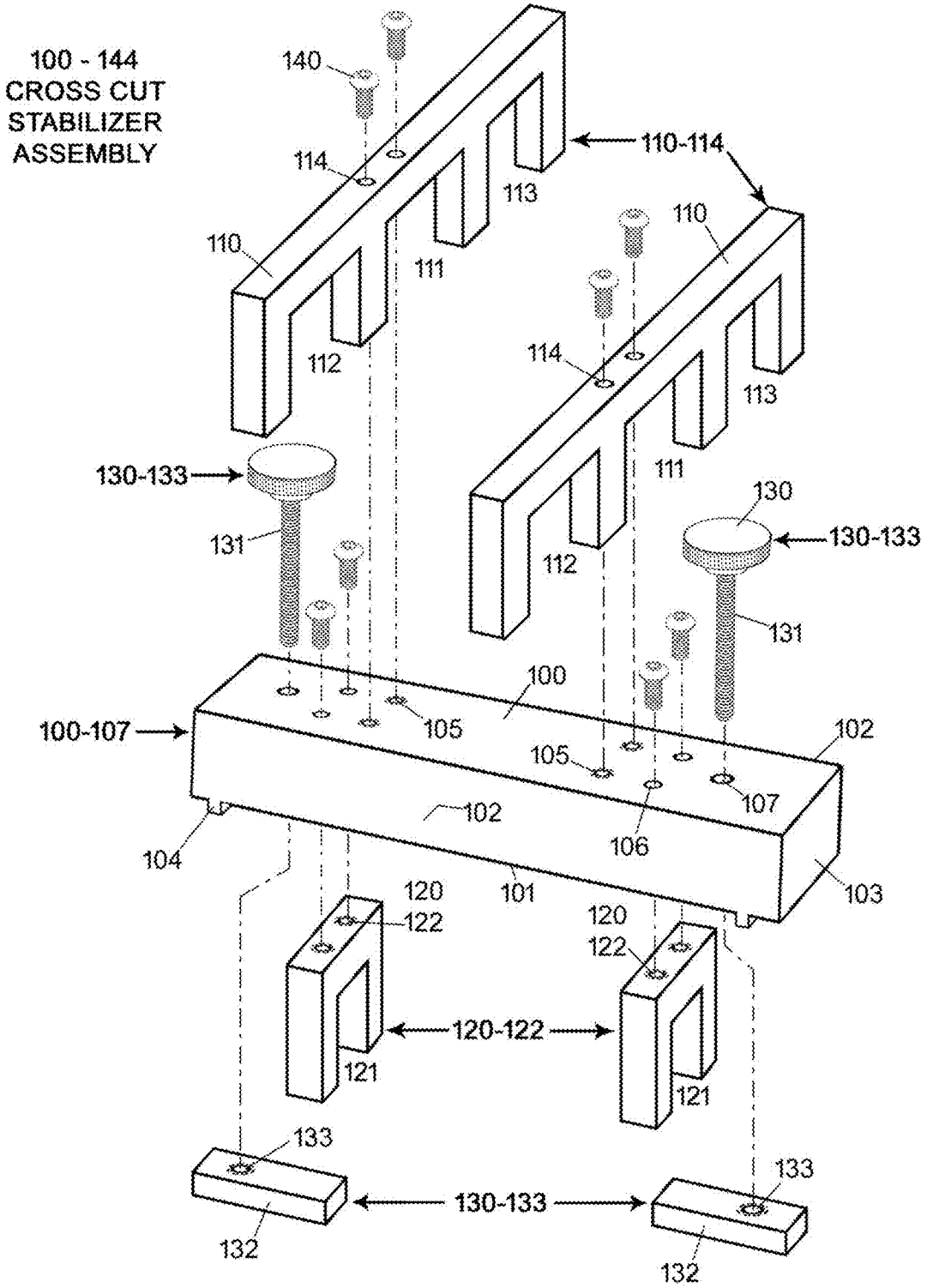
FIG. 4 is an exploded view of the cross-cut stabilizer assembly; the view shows a perspective view of each individual component incorporated into the assembly, along with component numbers and leaders pointing to each of said components; in accordance with an exemplary embodiment of the present invention.

As shown in FIGS. 03-04, the mounting base is a rectangularly-shaped block, housing on its top surface four threaded holes 105, four clearance holes 106, and two knob holes 107 (both the clearance and the knob holes protrude through the top and bottom surfaces of the block).

The pushing comb 110-114, is a comb-shaped component having a top surface 110, a mounting chamber 111, two through clearance holes 114, each originating on the top surface 100, a first chamber 112, and a second 113 chamber. When attached to the mounting base 100-107, the mounting chamber 111 straddles the base, and is fastened to the top surface 100 of the mounting block 100-107, using machine screws (ref. FIG. 04). In alternative, this pushing comb 110-114 may also be fastened to the mounting base 100-107 using either bolts or adhesive 140-144. The presented herein cross-cut stabilizer assembly utilizes two pushing combs. However, it is conceivable that a single pushing comb may be utilized to accomplish the same functions, and in alternative, more than two pushing combs may be utilized if extreme vibration of the machine creates more difficult to control operational conditions.

The clamp 130-133, also shown in FIGS. 03 and 04, comprises of a knob 130, a screw 131 (fixedly attached to the knob), and a jaw block 132 with a through threaded hole 133 therein. The stabilizer assembly shown in FIGS. 01-14 utilizes two clamps 130-133, but fewer, or more than two, clamps may be utilized if necessary. When properly installed, the screw 131 is inserted through the knob hole 107 of the mounting base 100-107, allowing the screw to protrude from the bottom surface 101 of the mounting base and into the jaw block's 132 threaded hole 133.

The manual turning of the knob 130 adjusts the size of the clamp 130-133. However, this adjustment would not be possible without the jaw guide 120-122. The jaw guide 120-122 comprises of a top surface 120, two threaded holes 122 (located on the top surface 120) and a chamber 121. The jaw guide 120-122 is attached to the bottom surface 101 of the mounting base 100-107. The end user may fasten the jaw block 132 to the mounting base 100-107 by using machine screws 140 or adhesive 144. The main function of the jaw guide 120-122 is to prevent rotation of the jaw block 132, when the knob/screw is turned manually for adjustment purposes. This is done by straddling the jaw block 132 inside the chamber 121, preventing it from turning, but allowing it to travel up and down, to enable the adjustment of the clamp's size.

Figure 6:
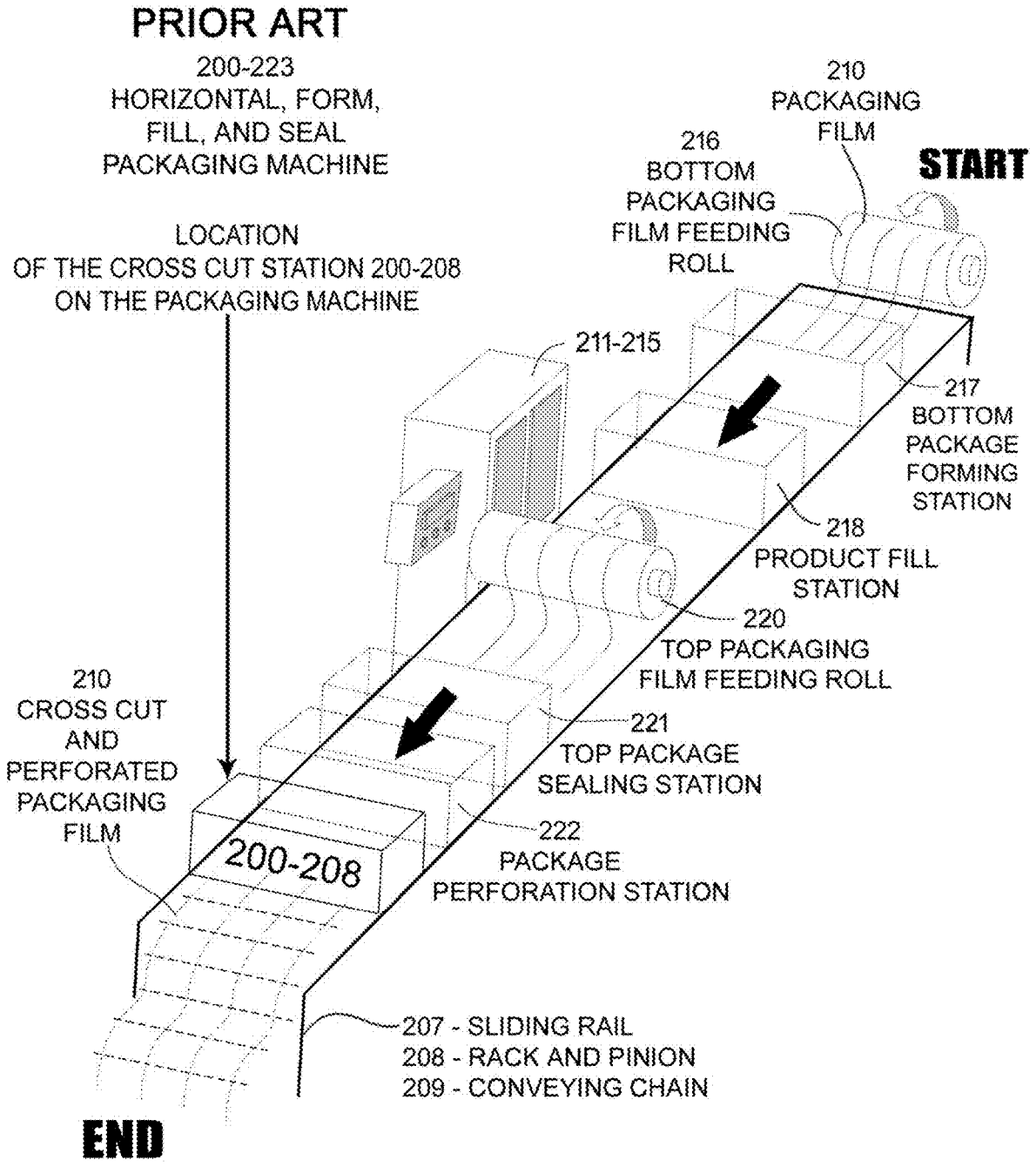
FIG. 6 is a simplified, perspective view of a horizontal, form, fill, and seal packaging machine (prior art); the view shows the location on the packaging machine of the cross-cut station (prior art), and the locations of other related stations/components, including the locations of the power/control station, packaging film, bottom packaging film feeding roll, conveying chain, bottom package forming station, product fill station, top packaging film feeding roll, and the top package sealing station; in accordance with an exemplary embodiment of the present invention.
Figure 7:
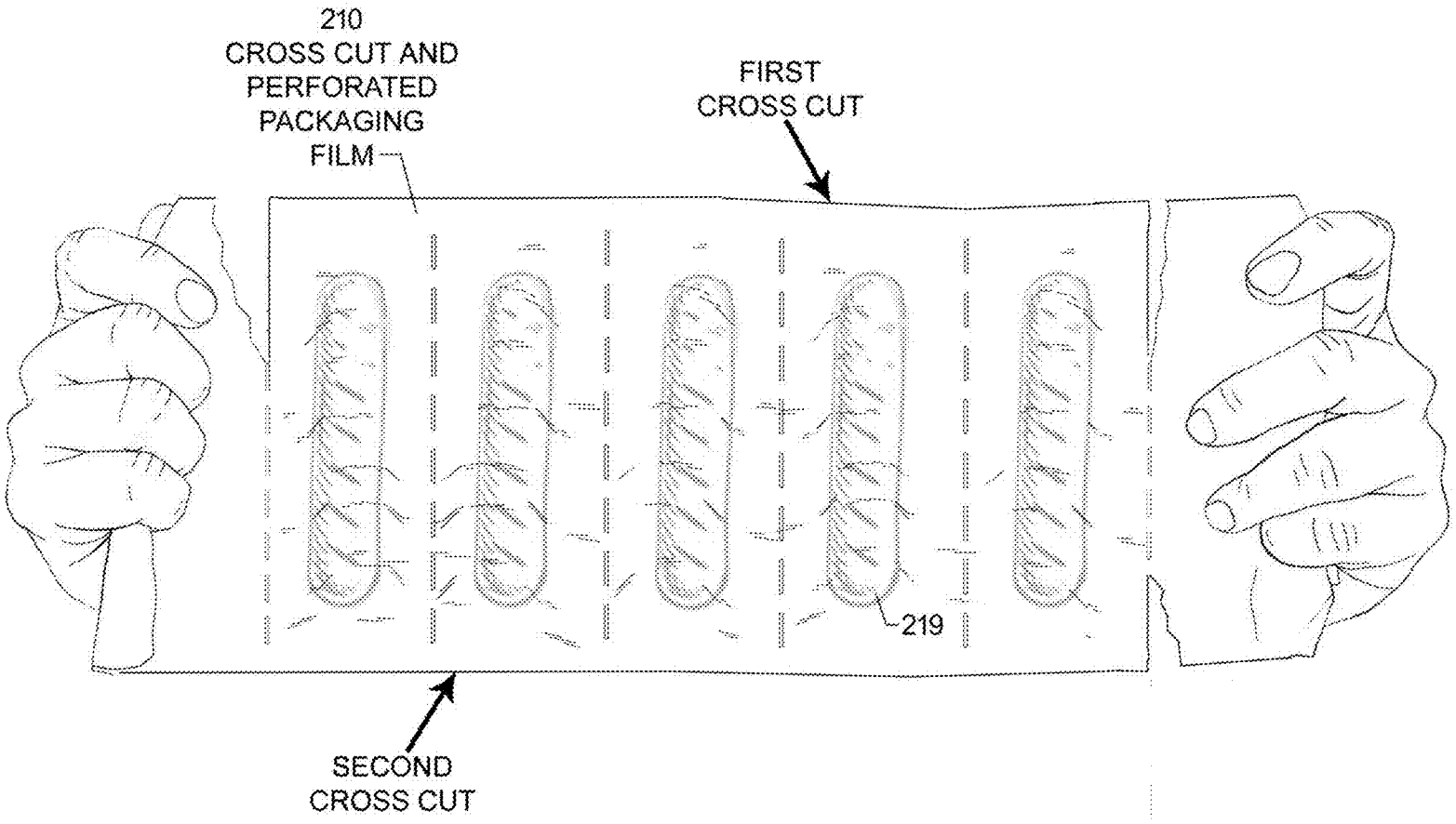
FIG. 7 shows how the first and the second cross-cuts, generated by the cross-cut system (prior art), is applied to the packaging film; specifically, the figure shows a person holding a strip of pre-packaged product (sausages), joined together by the packaging film, sub-divided into individual packages by a multitude of perforation lines, and separated from the rest of the packaging film fed by the convening chain, using the first and the second cross-cuts; in accordance with an exemplary embodiment of the present invention.

The cross-cut stabilizer 100-144 must be attached to the existing cross-cut station 200-208. The cross-cut station is typically one of the last operational stations on the packaging machine 200-222, as shown in FIG. 06. It is frequently preceded by various other functional stations, including but not limited to packaging film feeding station 216/220, package forming station 217, product fill station 218, top package sealing station 221, and package perforating station 222.

The machine 200-222 uses compressed air to form packages, heat staking to fuse and close the packages, and software to control both rotational and linear movement of components. The means for enabling usage on said packaging machine of compressed air to form packages, heat staking actions, linear motions, and rotational motions of mechanical components are selected from a group consisting of vacuum pumps, electric heaters, air compressors, linear slides, pneumatic cylinders, and electric motors.

Figure 5:
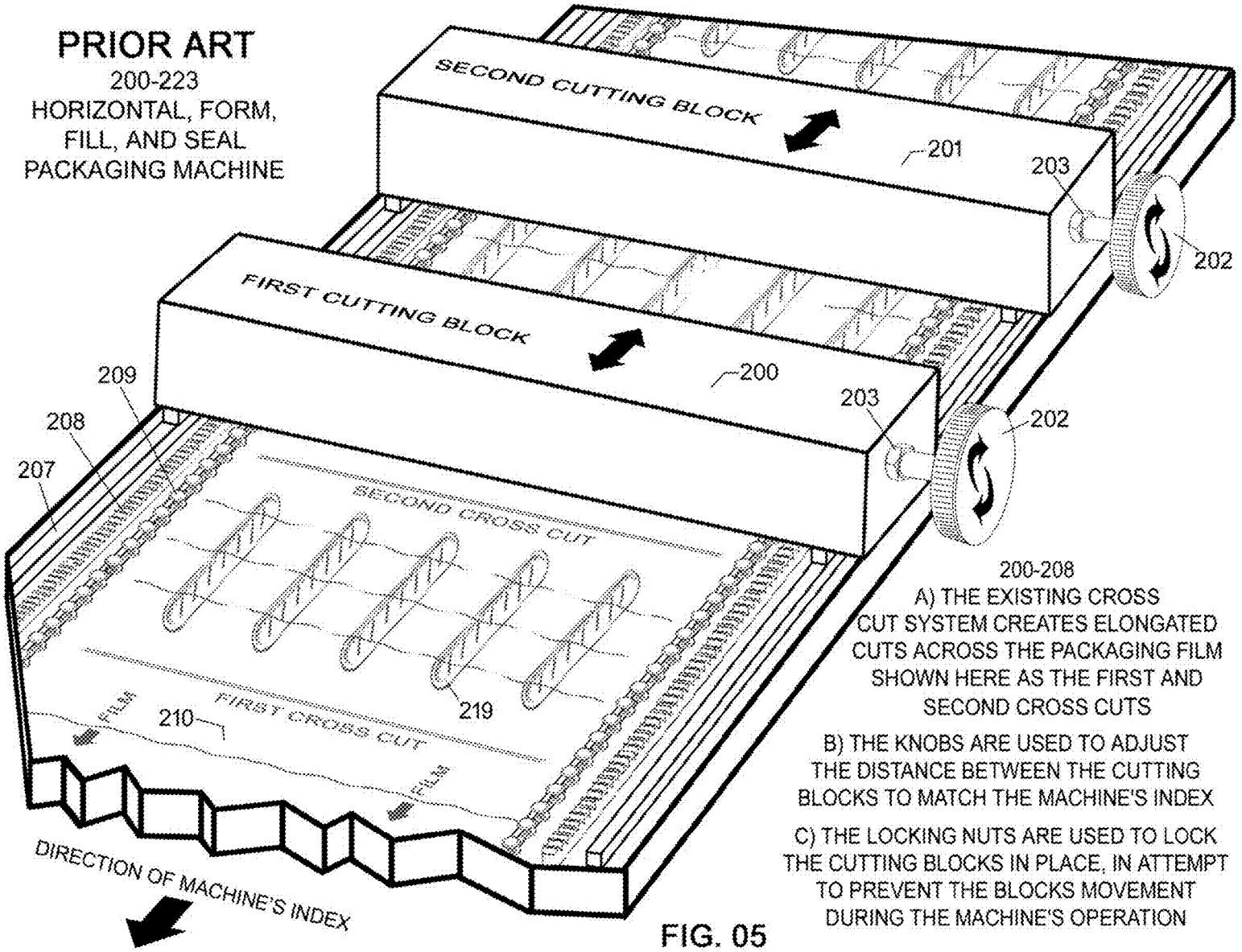
FIG. 5 is a perspective view of the cross-cut system (prior art) positioned on the horizontal, form, fill and seal packaging machine (prior art); specifically, the figure shows the packaged product, the packaging film, and the direction of the machine's index; shown are also locations of the sliding rail, convening chain, and the rack (part of the rack and pinion system), along with the first and the second cutting blocks, adjustment knobs, locking nuts, made to create the first and the second cross-cuts in the packaging film (also shown in this view); in accordance with an exemplary embodiment of the present invention.

As shown in FIG. 05, the cross-cut station 200-208 creates elongated cuts across in the packaging film 210, shown in this figure as the first and the second cross-cuts. The first cross-cut is created under the first cutting block 200, and the second cross-cut is created under the second cutting block 201.

Once the cross-cuts are completed, a strip of a prepackaged products 219 (shown in FIG. 07), subdivided by perforated film, is separated from the rest of the packaging film 210 being fed by the conveying chain 209.

The distance between the cross-cuts are easily adjusted by usage of the adjustment knobs 202, shown in FIG. 05. Each cutting block 200-201 has one adjustment knob located on its short side. Each of the knobs 202 incorporates a single locking nut 203. The nut 203 is used to lock the cutting block 200-201 in place, in attempt to prevent the block's movement during the machine's operation.

Figure 8:
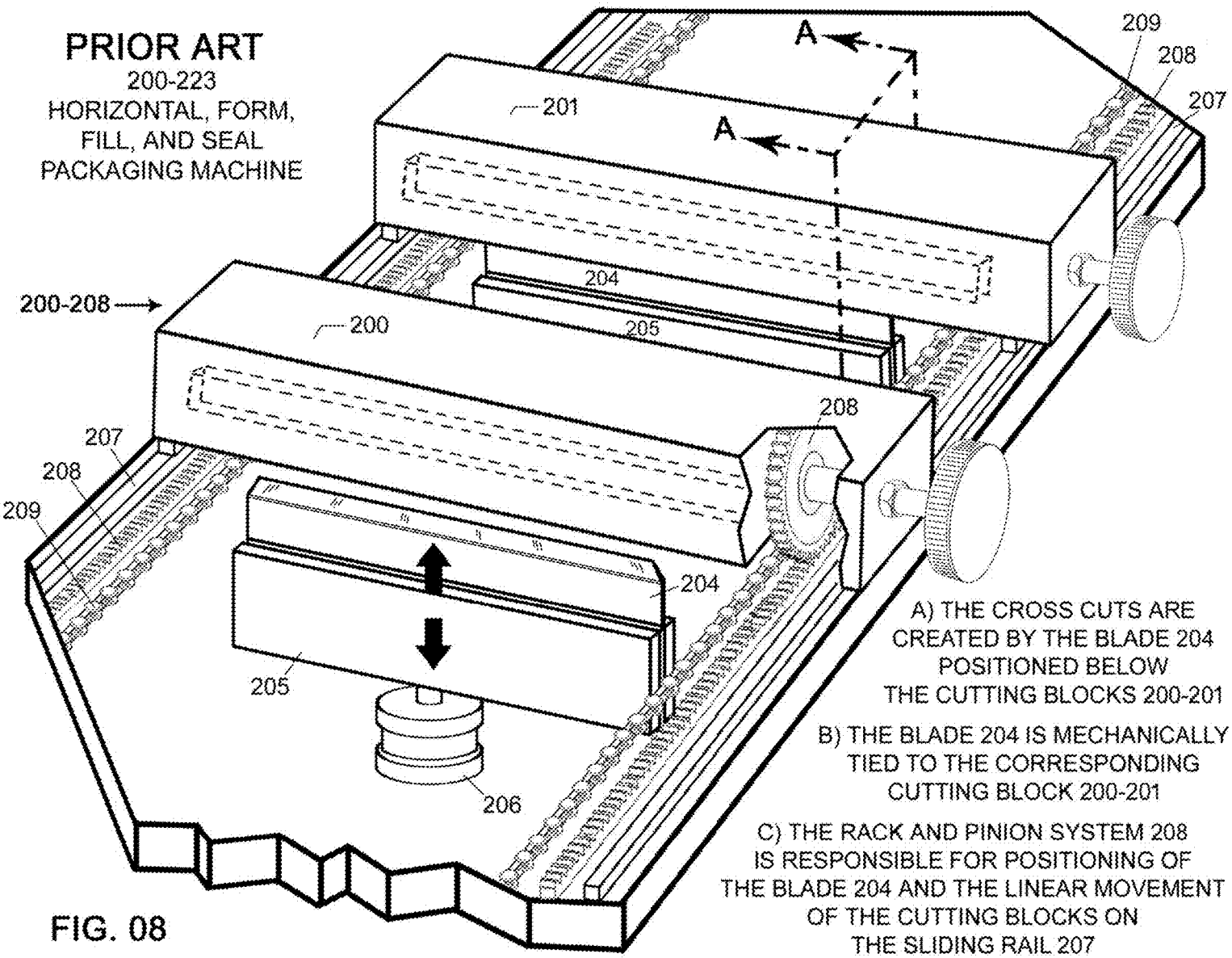
FIG. 8 is a perspective view of the cross-cut system (prior art) positioned on the horizontal, form, fill and seal packaging machine (prior art); specifically, the figure shows two cutting blocks of the cross-cut system, with one of the blocks exposing its internal structure using the rack and pinion system; the figure shows (1) the blade (used for making the cross-cuts in the packaging film); (2) the blade holders; (3) the pneumatic cylinder (used for lifting and lowering the blade); shown is also the location of the sectional view A-A, designed to highlight the shortcomings of the current, cross-cut system; in accordance with an exemplary embodiment of the present invention.

As shown in FIG. 08, the cross-cuts are created by the blades 204 positioned directly below the cutting blocks 200-201. The blades, held by the blade holders 205, are extended upward, and retracted downward via pneumatic cylinders 206. The blades 204 are mechanically tied to the corresponding cutting blocks 200-201, therefore a manual movement (or adjustment) of the cutting block to the left, will generate a corresponding movement of the blades.

This movement is accomplished by usage of a rack and pinion system, incorporated inside each one of the cutting blocks, as shown in FIG. 08. When moved, the cutting blocks are sliding on two sliding rails. One of the sliding rails is positioned paralleled to the rack and pinion systems (and next to the conveying chain), and the second sliding rail is positioned on the opposite side of machine, near the second rack and pinion system.

Figure 9:
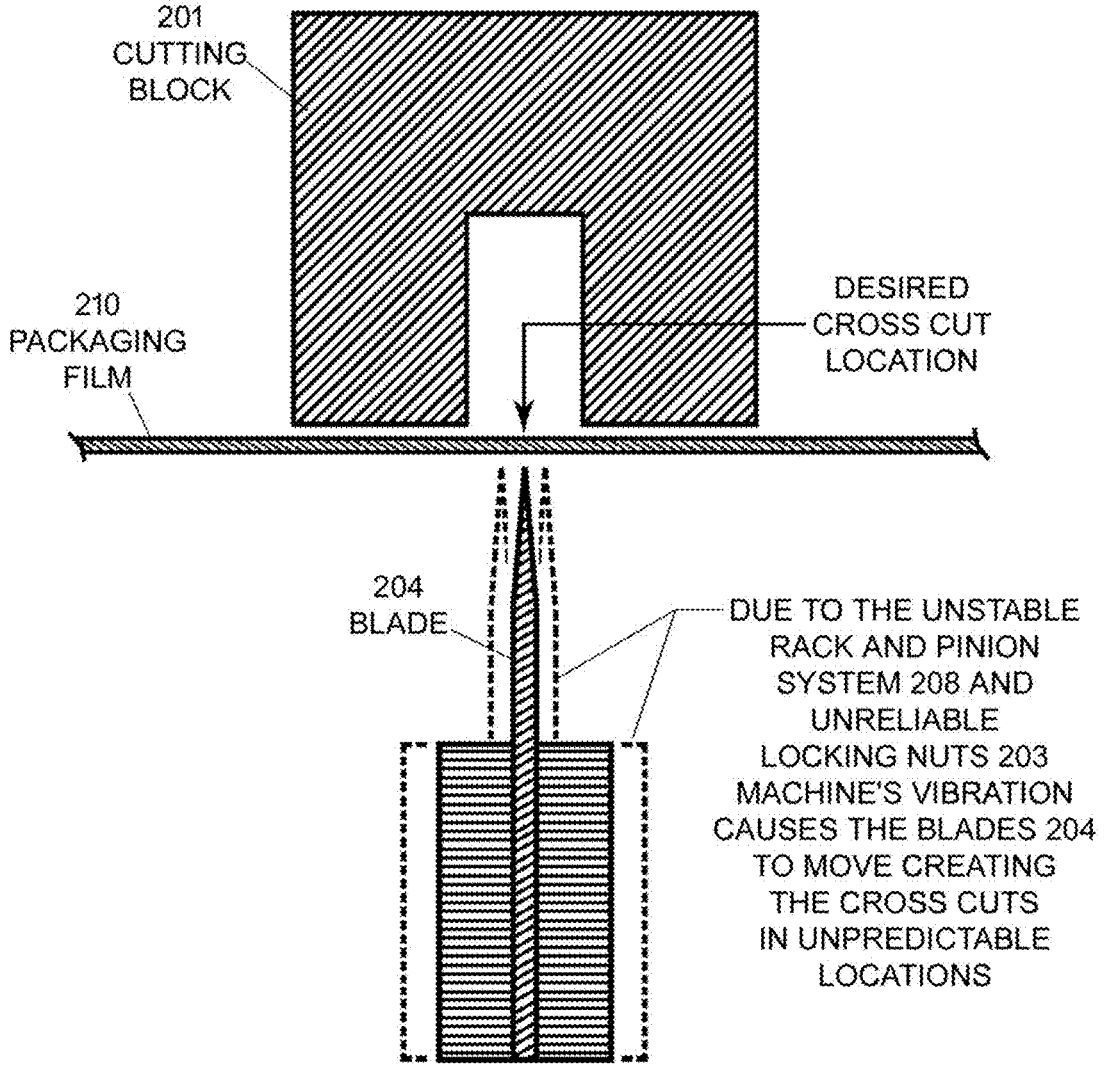
FIG. 9 is a sectional view A-A, showing the cutting block, the packaging film, and the blade being held by the blade holders; the figure shows that due to the unstable rack and pinion system (supporting the cutting blocks) and the unreliable locking nuts (failing to hold said cutting blocks in place) the vibration of the packaging machine is able to move the blade, resulting in creation of the cross-cuts in unpredictable locations; in accordance with an exemplary embodiment of the present invention.

As shown in FIG. 09, and specifically depicted by the sectional view A-A, the vibration created by the machine's operations, causes a progressive movement of the cutting blades 204. This progressive movement, at least in part, is attributed to the rack and pinion system 208 incorporated in the design of the existing cross-cut station 200-208. The other reason for the movement of the cross-cut station can be attributed to unreliable locking nuts 203. The locking nuts 203 have been designed to lock the cross-cut station 200-208 in place, and by doing so prevent its movement. However, after a prolonged exposure to the vibrating frame of the machine 200-222, the locking nuts 203 lose their grip, allowing the cross-cut station, along with the blades, to move in an unpredicted direction.

Figure 10:
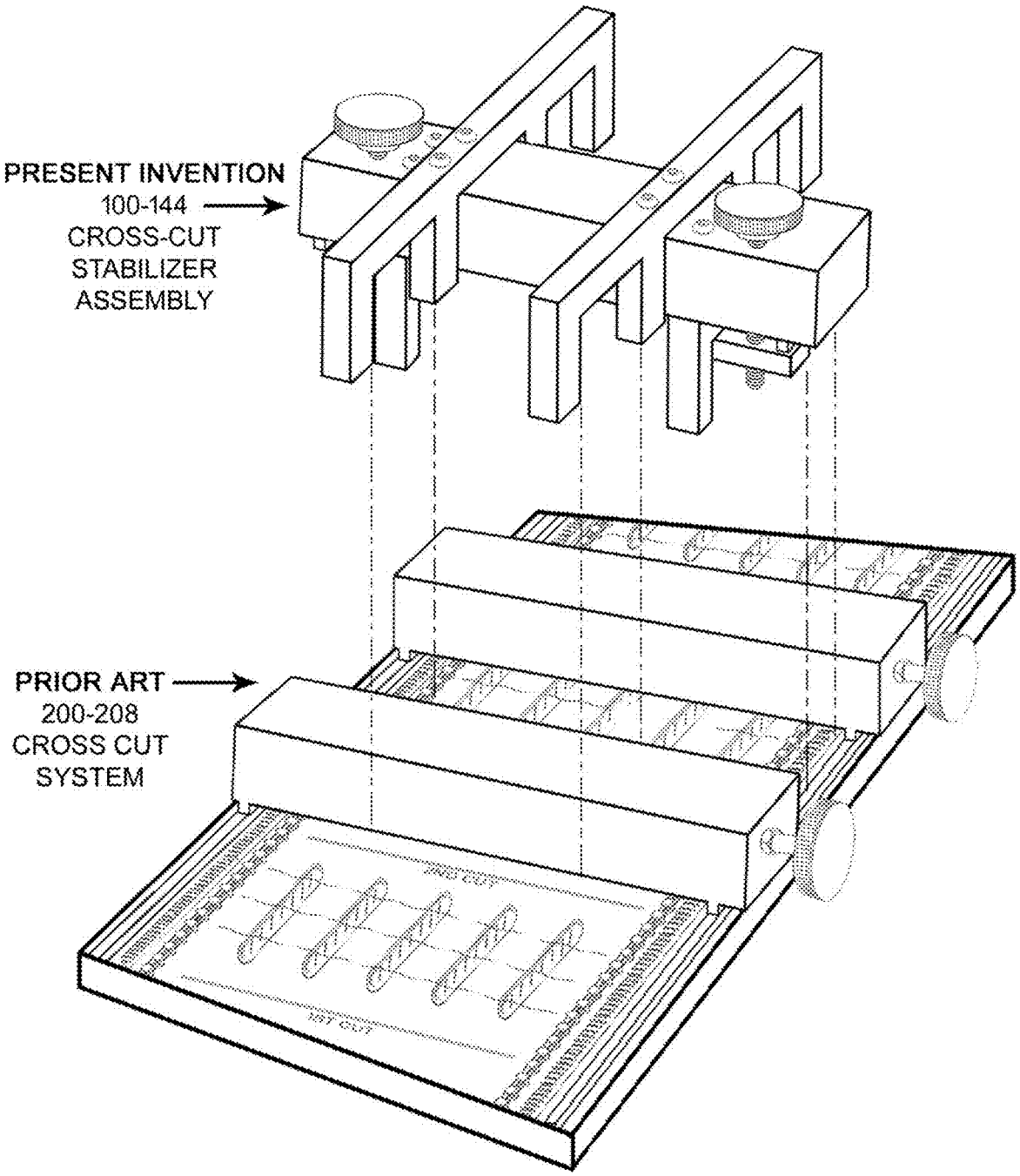
FIG. 10 is a perspective view of the cross-cut system (prior art) attached to the packaging machine (prior art), and a perspective view of the fully assembled cross-cut stabilizer assembly (present invention); the cross-cut stabilizer assembly is positioned directly above the packaging machine, and uses phantom lines to show the positioning of said assembly in relation to both the cross-cut system and the packaging machine; in accordance with an exemplary embodiment of the present invention.

As shown in FIG. 10, the cross-cut stabilizer 100-144 is mounted inside the cross-cut station 200-208. More specifically, and as shown in FIG. 11, it is the mounting base 100-107 of the cross-cut stabilizer 100-144 that is placed in-between the cutting blocks 200-201 of the cross-cut station, and when properly mounted, the stabilizer rests on the sliding rail 207.

Figure 11:
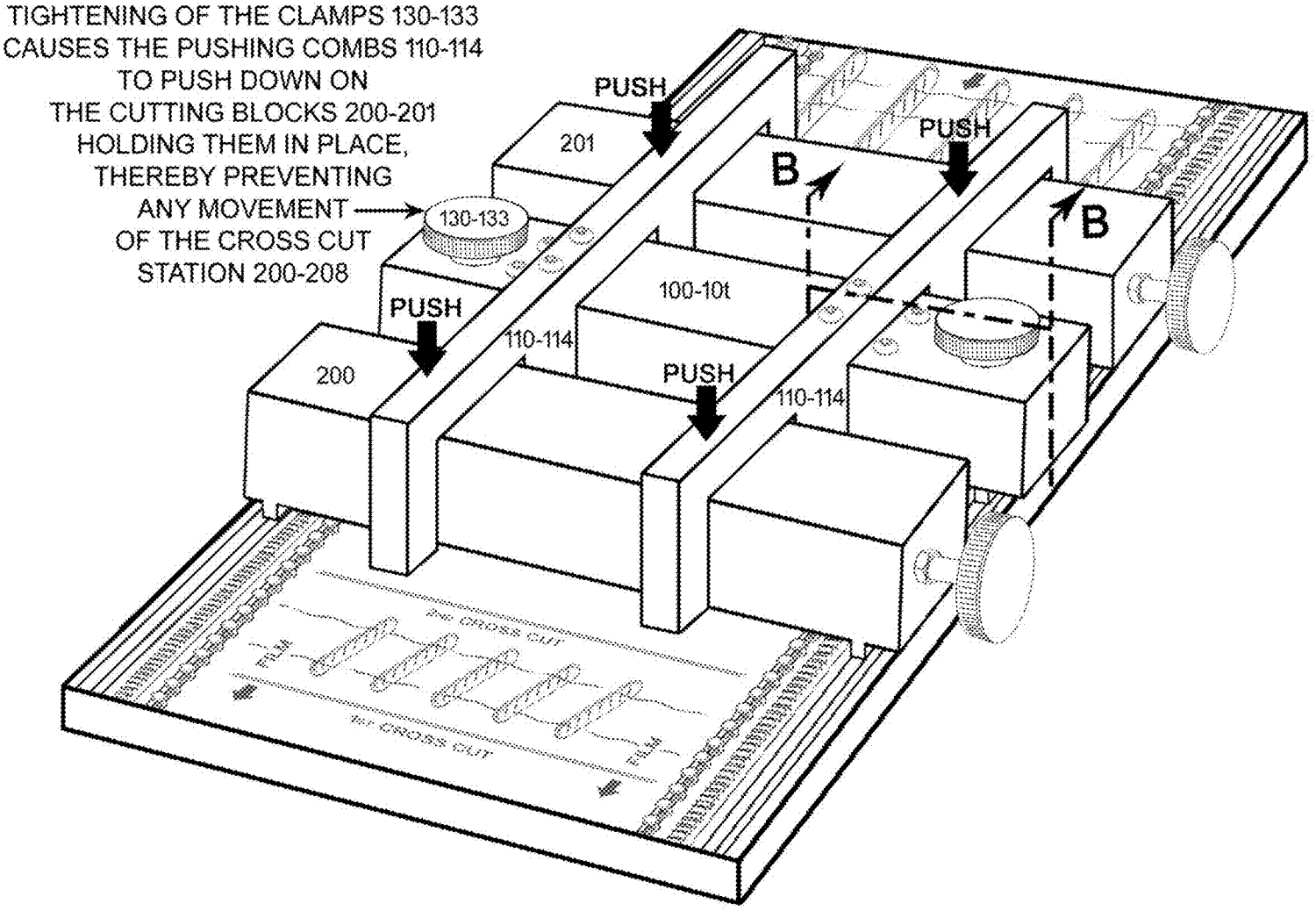
FIG. 11 is a perspective view of the fully assembled cross-cut stabilizer assembly (present invention) nestled within the cross-cut system (prior art) attached to the packaging machine (prior art); the figure shows the location of the sectional view B-B, and provides an annotation which states that tightening of the clamps of the cross-cut stabilizer, causes the combs of the stabilizer to push down on the cutting blocks of the cross-cut station, firmly holding them in place (thereby stabilizing the entire cross-cut station); in accordance with an exemplary embodiment of the present invention.

When in position, the pushing combs 110-114 straddle the cutting blocks 200-201, as shown in FIG. 11, urging upon the cutting blocks, and in doing so preventing their movement. The pushing combs 110-114 also enable simultaneous, manual adjustment of both the cross-cut station 200-208 with the cross-cut stabilizer 100-144.

Figure 12:
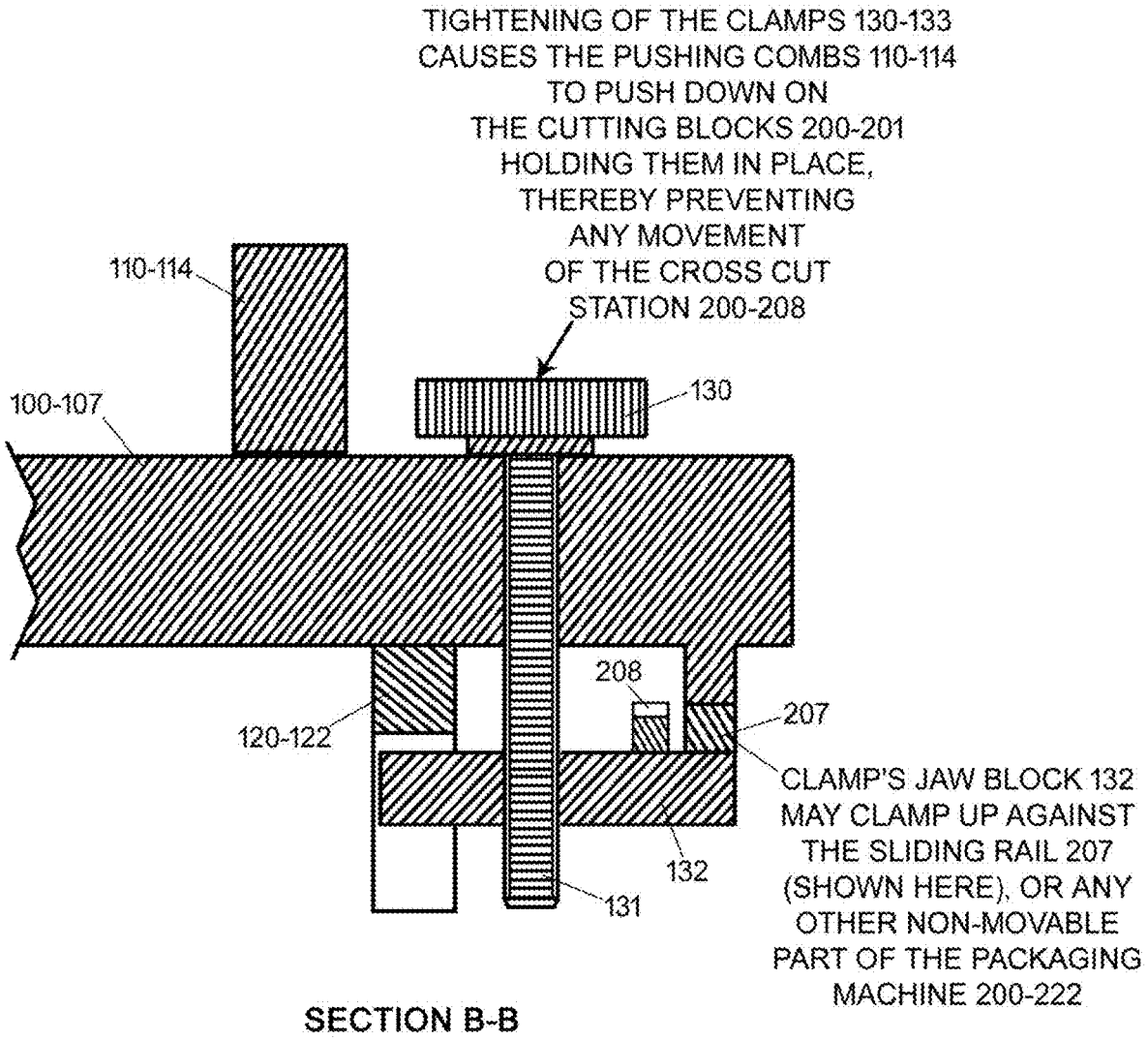
FIG. 12 is a sectional view B-B, showing the means of utilizing the clamp; specifically, the figure shows how the clamp (placed inside the mounting base) and its jaw block (aligned by the jaw guide) is pushing up against the sliding rail of the packaging machine; the figure also shows two annotations: (1) tightening of the clamps 130-133 causes the pushing combs 110-114 to push down on the cutting blocks 200-201 holding them in place thereby preventing any movement of the cross-cut station 200-208; (2) The clamp's jaw block 132 may clamp up against the sliding rail 207 (shown here), or any other non-movable part of the packaging machine 200-222; in accordance with an exemplary embodiment of the present invention.

The clamps 130-133, as shown in the sectional view B-B of FIG. 12, using the jaw block 132 clamp, is clamped between the mounting base 100-107 and the sliding rail 207 (or any other immovable component of the machines). The manual adjustment of the clamp 130-133 will either increase or decrease the force the pushing combs apply on the cutting blocks 200/201 of the cross-cut station, allowing the end-used to make the desired adjustments.

Figure 13:
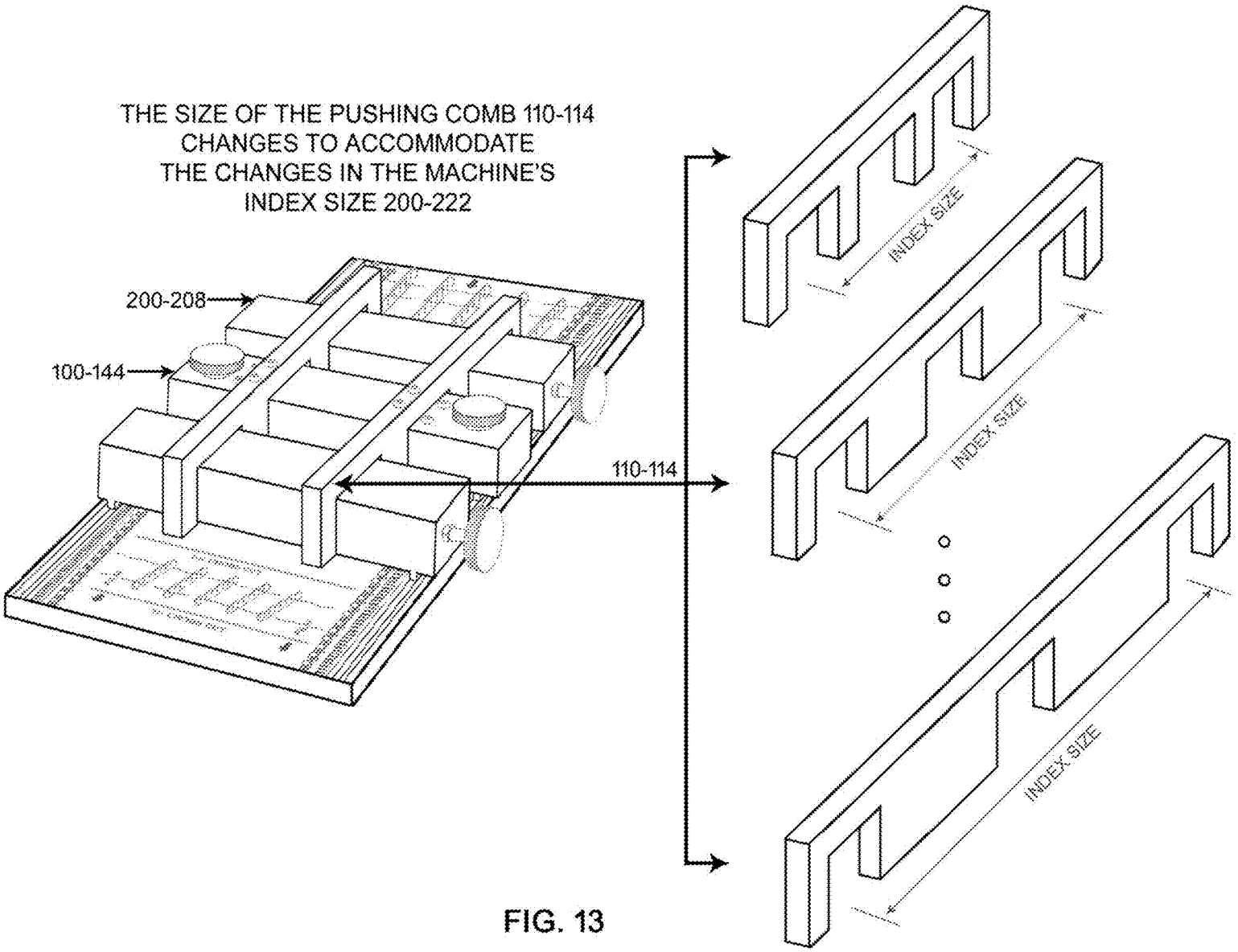
FIG. 13 is a perspective view of the fully assembled cross-cut stabilizer assembly (present invention) nestled within the cross-cut system (prior art) attached to the packaging machine (prior art) with three pushing combs, each showing progressively larger index size; the figure also includes an annotation, stating that the size of the pushing comb 110-114 changes to accommodate the changes in the machine's index; in accordance with an exemplary embodiment of the present invention.
Figure 14:
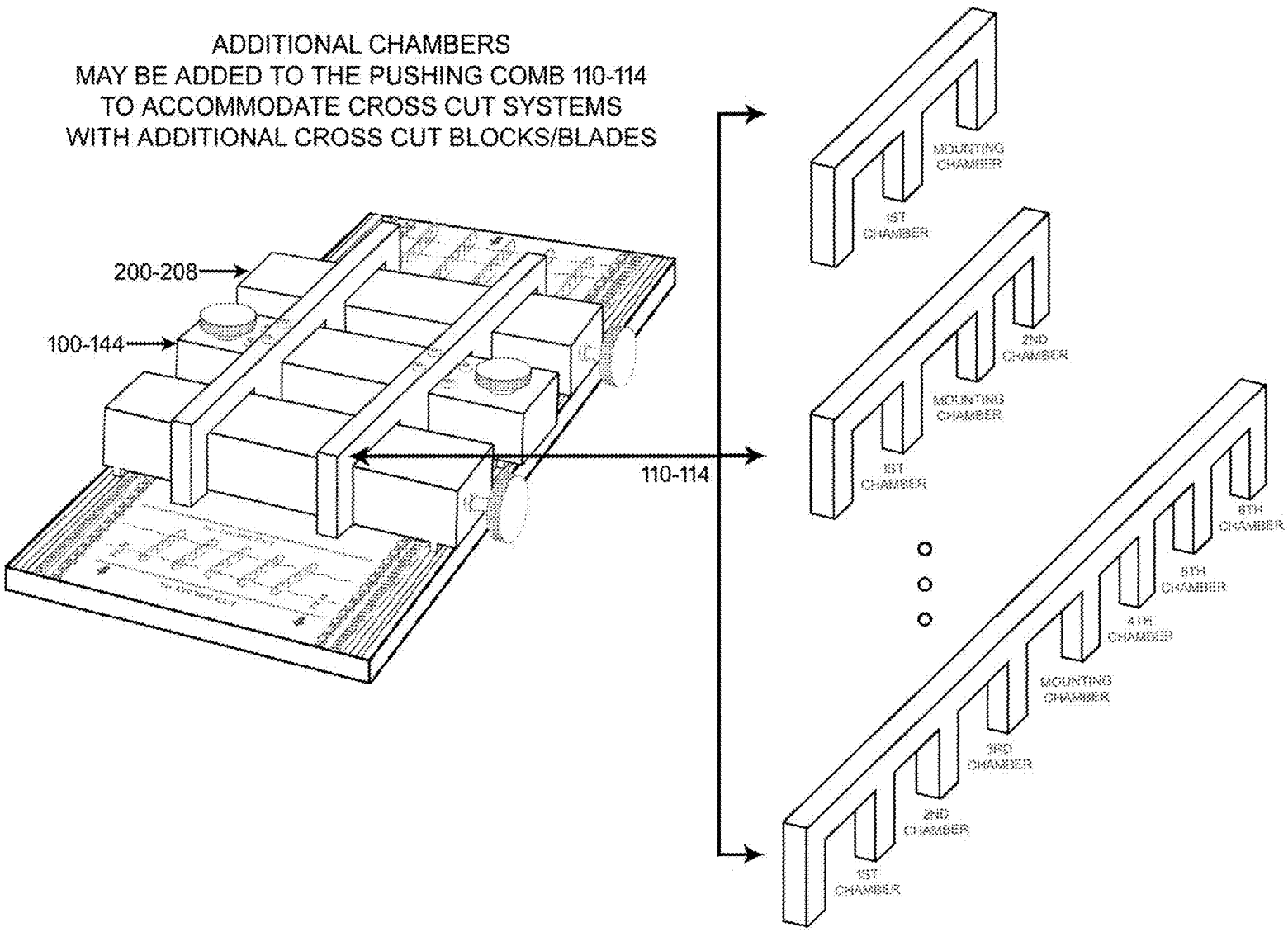
FIG. 14 is a perspective view of the fully assembled cross-cut stabilizer assembly (present invention) nestled within the cross-cut system (prior art) attached to the packaging machine (prior art) with three pushing combs, each showing progressively greater number of mounting chambers (for housing cutting blocks); the figure also includes an annotation, stating that additional chambers may be added to the pushing comb to accommodate cross-cut systems with additional cross-cut clocks/blades; in accordance with an exemplary embodiment of the present invention.

As shown in FIG. 13, the size of the pushing combs 110-114 may be changed to accommodate the changes in the machines 200-222 index size (distances between cuts corresponding to the distances between the operation stations). The pushing combs 110-114 may also incorporate one or a multitude of chambers 112/113 to accommodate the existing cross-cut systems with a large number of cutting blocks/blades, as shown in FIG. 14.

I claim:

1. A horizontal, form, fill and seal packaging machine, comprising:

A) a plurality of processing stations, having
- (a) a means for enabling usage on said packaging machine of compressed air to form packages, heat staking actions, linear motions, and rotational motions of mechanical components;
- (b) a power and control station utilizing a computer software, configured to control mechanical components, and the processing station of the packaging machine;
- (c) a packaging film configured to act as a packaging material for a packaged product;
- (d) a conveying chain for conveying the packaging film in a horizontal plane between the processing stations of the packaging machine;
- (e) a bottom packing film feeding roll configured to supply material used to form a bottom portion of the package;
- (f) a bottom package forming station configured to use compressed air to form a bottom portion of the package;
- (g) a product fill station configured to manually or by using an automated system to fill the bottom portion of the package with the packaged product;
- (h) a top packaging film feeding roll configured to supply material used to form a top portion of the package;
- (i) a package sealing station configured to complete formation of the package by heat staking together the bottom portion of the package to the top portion of the package;
- (j) a package perforation station configured to create perforations in the packaging film thereby separating a strip of packages into individual packages,
- (k) a cross-cut station configured to create cross-cuts in the packaging film, thereby detaching the strip of package from the packaging film conveyed by the packaging machine, comprising:
  - (i) a plurality of blades for cutting the cross-cuts in the packaging film, wherein each blade is held by a blade holder, and configured via a pneumatic cylinder to extend and to retract vertically;
  - (ii) a plurality of cutting blocks for aligning locations of the cross-cuts, wherein a first cutting block is configured to align a location of a first cross-cut, and a second cutting block is configured to align a location of a second cross-cut;
  - (iii) a rack and pinion system configured to enable linear movement of the cutting blocks by disposing the rack near the conveying chain, and by disposing the pinion inside each of the cutting blocks enabling said cutting blocks to move linearly along the surface of the rack;
  - (iv) a plurality of adjustment knobs with one adjustment knob disposed on each of the cutting blocks, and configured to move the cutting blocks via the rack and pinion system by manually turning the adjustment knobs in either clockwise or counter-clockwise directions;
  - (v) a plurality of locking nuts with one locking nut disposed on each of the cutting blocks, and configured to prevent rotation of the adjustment knobs thereby preventing movement of the cutting blocks;

(vi) two sliding rails where each sliding rail is disposed contiguous to the cutting block and near the conveying chain, configured to allow the cutting blocks to slide on its surface; and B) a cross-cut stabilizer mounted to the cross-cut station, and configured to fixedly hold the cutting blocks in place thereby preventing movement of the cross-cut station due to vibration caused by operation of the packaging machine, comprising:

(a) a mounting base fixedly attached to the cross-cut station, having a top surface, four threaded holes disposed on the top surface, a bottom surface, two sliding steps protruding from the bottom surface and configured to slide on the sliding rails, two knob holes protruding in from the top surface and out of the bottom surface, four clearance holes protruding in from the top surface and out from the bottom surface, two long sides, and two short sides;

(b) two pushing combs, each fixedly attached to the top surface of the mounting base straddling the cutting blocks, configured to enable a unison adjustment of the cross-cut station and the cross-cut stabilizer, and configured to push upon the cutting blocks thereby preventing their movement; each of said pushing combs comprises a top surface with two through clearance holes for mounting the pushing comb to the top surface of the mounting base, a mounting chamber configured to straddle the mounting base, a plurality of chambers wherein a first chamber is configured to straddle the first cutting block and a second chamber is configured to straddle the second cutting block;

(c) two clamps configured to lower the cross-cut stabilizer upon manual adjustment of the clamps, thereby enabling the two pushing combs to urge upon the cutting blocks.

2. The horizontal, form, fill and seal packaging machine of claim 1 wherein:

said cutting block further comprises a recessed channel configured to prevent contact of the cutting blocks with the blades.

3. The horizontal, form, fill and seal packaging machine of claim 1 wherein:

said two pushing combs are fixedly mounted to the top surface of the mounting base via machine screws.

4. The horizontal, form, fill and seal packaging machine of claim 1 wherein:

said two pushing combs are fixedly mounted to the top surface of the mounting base using fasteners selected from a group consisting of bolts, nuts, washers and adhesive.

5. The horizontal, form, fill and seal packaging machine of claim 1 wherein each of said clamps is further comprising:

A) a jaw block with a threaded hole protruding through, configured to push and fixedly hold one of the sliding rails;

B) a knob with a screw fixedly attached thereto being long enough to protrude through the mounting base and into the threaded hole of the jaw block; wherein said knob is configured to lower the cross-cut stabilizer upon manual adjustment of the knob; and C) two jaw guides each having a top surface, two threaded holes disposed in the top surface for attaching thereof to the mounting base, and a chamber configured to guide the jaw block and to prevent its rotation.

6. The horizontal, form, fill and seal packaging machine of claim 5 wherein:

said jaw block is configured to push and fixedly hold onto an immovable component of the packaging machine.

7. The horizontal, form, fill and seal packaging machine of claim 5 wherein:

said jaw guides are attached to the mounting base using fasteners selected from a group consisting of machine screws, bolts, nuts, washers and adhesive.

8. The horizontal, form, fill and seal packaging machine, comprising:

A) a cross-cut station configured to create cross-cuts in a packaging film, thereby detaching a strip of package from the packaging film conveyed by the packaging machine, comprising:

(a) a plurality of blades for cutting the cross-cuts in the packaging film, wherein each blade is held by a blade holder, and configured via a pneumatic cylinder to extend and to retract vertically;

(b) a plurality of cutting blocks for aligning locations of the cross-cuts, each having a recessed channel to prevent a contact of the cutting blocks with the blades; wherein a first cutting block is configured to align a location of a first cross-cut, and a second cutting block is configured to align a location of a second cross-cut;

(c) a rack and pinion system configured to enable linear movement of the cutting blocks by disposing the rack near the conveying chain, and by disposing the pinion inside each of the cutting blocks enabling said cutting blocks to move linearly along the surface of the rack;

(d) a plurality of adjustment knobs with one adjustment knob disposed on each of the cutting blocks, and configured to move the cutting blocks via the rack and pinion system by manually turning the adjustment knobs in either clockwise or counterclockwise directions;

(e) a plurality of locking nuts with one locking nut disposed on each of the cutting blocks, and configured to prevent rotation of the adjustment knobs thereby preventing movement of the cutting blocks;

(f) two sliding rails where each sliding rail is disposed contiguous to the cutting block and near the conveying chain, configured to allow the cutting blocks slide on its surface; and B) a cross-cut stabilizer mounted to the cross-cut station, and configured to fixedly hold the cutting blocks in place thereby preventing movement of the cross-cut station due to vibration caused by operation of the packaging machine, comprising:

(a) a mounting base fixedly attached to the cross-cut station, having a top surface, four threaded holes disposed on the top surface, a bottom surface, two sliding steps protruding from the bottom surface and configured to slide on the sliding rails, two knob holes protruding in from the top surface and out of the bottom surface, four clearance holes protruding in from the top surface and out from the bottom surface, two long sides, and two short sides;

(b) two pushing combs, each fixedly attached to the top surface of the mounting base straddling the cutting blocks, configured to enable a unison adjustment of the cross-cut station and the cross-cut stabilizer, and configured to push upon the cutting blocks thereby preventing their movement; each of said pushing combs comprises a top surface with two through clearance holes for mounting the pushing comb to the top surface of the mounting base, a mounting chamber configured to straddle the mounting base, a plurality of chambers wherein a first chamber is configured to straddle the first cutting block and a second chamber is configured to straddle the second cutting block;

(c) two clamps, each comprising a jaw block with a threaded hole protruding through configured to push and fixedly hold one of the sliding rails, a knob with a screw fixedly attached thereto being long enough to protrude through the mounting base and into the threaded hole of the jaw block; wherein said clamps upon manual adjustment of the knob lower the cross-cut stabilizer, enabling the two pushing combs to urge upon the cutting blocks, thereby preventing movement of the cross-cut station;

(d) two jaw guides each having a top surface, two threaded holes disposed in the top surface for attaching thereof to the mounting base, and a chamber configured to guiding the jaw block and to prevent its rotation.

9. The horizontal, form, fill and seal packaging machine of claim 8 wherein:

said two pushing combs are fixedly mounted to the top surface of the mounting base using fasteners selected from a group consisting of machine screws, bolts, nuts, washers, and adhesive.

10. The horizontal, form, fill and seal packaging machine of claim 8 wherein:

said jaw guides are attached to the mounting base using fasteners selected from a group consisting of machine screws, bolts, nuts, washers and adhesive.

11. A horizontal, form, fill and seal packaging machine, comprising:

A) a mounting base fixedly attached to a cross-cut station of the packaging machine, having a top surface, four threaded holes disposed on the top surface, a bottom surface, two sliding steps protruding from the bottom surface configured to slide on sliding rails of the packaging machine, two knob holes protruding in from the top surface and out of the bottom surface, four clearance holes protruding in from the top surface and out from the bottom surface, two long sides, and two short sides;

B) two pushing combs, each fixedly attached to the top surface of the mounting base straddling cutting blocks of the packaging machine, configured to enable a unison adjustment of the cross-cut station and the cross-cut stabilizer, and configured to push upon the cutting blocks thereby preventing their movement; wherein each of said pushing combs comprises a top surface with two through clearance holes for mounting the pushing comb to the top surface of the mounting base, a mounting chamber configured to straddle the mounting base, a plurality of chambers wherein a first chamber is configured to straddle a first cutting block and a second chamber is configured to straddle a second cutting block;

C) two clamps, each comprising a jaw block with a threaded hole protruding through configured to push and fixedly hold one of the sliding rails, a knob with a screw fixedly attached thereto being long enough to protrude through the mounting base and into the threaded hole of the jaw block; wherein said clamps upon manual adjustment of the knob lower the cross-cut stabilizer enabling the two pushing combs to urge upon the cutting blocks, thereby preventing movement of the cross-cut station; and D) two jaw guides each having a top surface, two threaded holes disposed in the top surface for attaching thereof to the mounting base, and a chamber configured to guiding the jaw block and to prevent its rotation.

12. The horizontal, form, fill and seal packaging machine of claim 11 wherein:

said two pushing combs are fixedly mounted to the top surface of the mounting base using fasteners selected from a group consisting of machine screws, bolts, nuts, washers, and adhesive.

13. The horizontal, form, fill and seal packaging machine of claim 11 wherein:

said jaw guides are attached to the mounting base using fasteners selected from a group consisting of machine screws, bolts, nuts, washers and adhesive.

* * * * *